US008286460B2

(12) United States Patent
Frattini

(10) Patent No.: US 8,286,460 B2
(45) Date of Patent: Oct. 16, 2012

(54) PROCESS AND APPARATUS TO MAKE AN EDGE OR A COLLAR FEATURING A COMPLEX STRUCTURE ON METAL ROUGH PIECES

(75) Inventor: Roberto Frattini, Ponteranica (IT)

(73) Assignee: Frattini S.p.A. Costruzioni Meccaniche, Seriate (IT)

( * ) Notice: Subject to any disclaimer, the term of this patent is extended or adjusted under 35 U.S.C. 154(b) by 1032 days.

(21) Appl. No.: 12/225,138

(22) PCT Filed: Jan. 23, 2007

(86) PCT No.: PCT/EP2007/000534

§ 371 (c)(1),
(2), (4) Date: Sep. 15, 2008

(87) PCT Pub. No.: WO2007/124792

PCT Pub. Date: Nov. 8, 2007

(65) Prior Publication Data

US 2009/0165526 A1 Jul. 2, 2009

(30) Foreign Application Priority Data

Apr. 27, 2006 (IT) ..... MI06A0833

(51) Int. Cl.
*B21D 11/10* (2006.01)

(52) U.S. Cl. ..... 72/379.4; 72/112; 72/115; 72/125; 72/126

(58) Field of Classification Search ..... 72/80, 84, 72/85, 86, 101, 107, 110, 115, 125, 126, 72/379.4, 112; 413/69, 76
See application file for complete search history.

(56) References Cited

U.S. PATENT DOCUMENTS

| | | | | |
|---|---|---|---|---|
| 2,337,182 | A | 12/1943 | Amos et al. | |
| 2,359,775 | A | 10/1944 | McManus et al. | |
| 3,096,546 | A * | 7/1963 | Edwards | 264/285 |
| 3,633,469 | A * | 1/1972 | Kinney | 493/159 |
| 5,187,962 | A * | 2/1993 | Bilko et al. | 72/62 |
| 7,171,840 | B2 * | 2/2007 | Kanou et al. | 72/379.4 |
| 7,497,350 | B2 * | 3/2009 | Enoki et al. | 220/658 |

FOREIGN PATENT DOCUMENTS

| | | |
|---|---|---|
| DE | 197 18 014 A1 | 11/1998 |
| EP | 1 167 222 A2 | 1/2002 |

OTHER PUBLICATIONS

International Search Report Mar. 2007.

* cited by examiner

*Primary Examiner* — Edward Tolan
(74) *Attorney, Agent, or Firm* — Bucknam and Archer

(57) ABSTRACT

A process and apparatus to make an edge or a collar featuring a complex structure on extruded, deep-drawn and deep-drawn/wire-drawn metal rough pieces with which bottles for the beverage and food sector or for technical use are particularly obtained, suitable for the application of a closing cap and fit to use on a tapering machine. The process includes a starting operating stage to deform an upper end portion of a metal holder by turning it outwardly so as to obtain an edge or a collar with a basically circular section, one or more intermediate operating stages to deform the edge or collar by squeezing in the radial direction and stretching towards the bottom of the metal holder, a final operating deformation stage to obtain an edge or collar with a complex ovoidal profile for the application of at least two caps of different types.

28 Claims, 10 Drawing Sheets

PROCESS AND APPARATUS TO MAKE AN EDGE OR A COLLAR FEATURING A COMPLEX STRUCTURE ON METAL ROUGH PIECES

CROSS REFERENCE TO RELATED APPLICATIONS

This application is the National Stage of PCT/EP2007/000534 filed on Jan. 23, 2007, which claims priority under 35 U.S.C. §119 of Italian Application No. MI2006A000833 filed on Apr. 27, 2006, the disclosure of which is hereby incorporated by reference. The international application under PCT article 21(2) was published in English.

TECHNICAL FIELD

This invention refers to a process and related apparatus to make an edge or a collar featuring a complex structure on extruded, deep-drawn and deep-drawn/wire-drawn metal rough pieces.

More particularly, this invention refers to a process and apparatus to make, on the upper end of a metal holder or body, an edge or a collar that fits the ensuing application of a sealing cap.

BACKGROUND ART

Metal holders that are subject to the process of this invention are especially, but not exclusively, those made of aluminium, its alloys, steel or other suitable materials from which bottles for the beverage and food sectors or for technical use are made.

The primitive shape of these metal holders is basically cylindrical and it is later shaped according to known procedures and technologies; even the tapering process of the upper end of these metal bodies or holders is made according to known technologies and, hence, is not described.

The foregoing metal holders are deformed close to their upper end, to make the edge or collar described in this process, preferably at the final stages of the working process, that is after having undergone the multiple operating stages for the shaping of the external surface and/or the embossing/debossing operating stages, that is those processing stages that create over preset areas of the side surface shaped marks, grooves and other patterns of various shapes defined by hollow and/or embossed sectors.

These same metal holders or bodies, possibly painted and/or lithographed, are basically fed on a tapering machine which, in a preferential embodiment which is not meant to provide any limitation, is such as to include at least a rotating table featuring intermittent movement, with multiple stations equipped with pliers or similar tools for the temporary fastening of bodies and at least an opposed plate provided with an alternating shifting motion on which are several tools and/or mandrels, which are meant to intervene at pre-set sequences on the extruded deep-drawn and deep-drawn/wire-drawn bodies in order to accomplish the progressive stages of initial deformation and later tapering of the upper end.

In order to perform both the tapering and the embossing/debossing operations, the metal holder processing machine avails of holder gripping and stabilization means of known type which, wherefore, are not described herein.

In recent times the market has revealed greater interest for metal holders featuring structures that are similar to those that are traditionally peculiar to holders made of other materials, such as plastic or glass, hence it has become important to provide these new holders, basically intended to serve the beverage market, with closure types that are similar to those of plastic (PET) or glass holders.

Glass holders, for instance, though featuring aesthetic values that definitely surpass those of traditional metal holders or bodies, present the disadvantage of weighing too much, of being easily subject to breakage and entailing high production costs; vice versa, the metal holder, in addition to the required level of hygiene, can also ensure greater lightness compared to glass, is infrangible, easily disposable and recycled. Nevertheless, as the dealing is with bottles or holders made of metal, it is important that the working of the upper end of the mentioned bottle results in the performance of an edge that is shaped in such a manner as not to present cutting edges that may irritate or even bring about potential hazards to the user who draws the holder close to his mouth in order to drink straight from it.

As far as holders made of metal are concerned, there are various types of closures, such as, for instance, the application of a "crown" cap, a "ring-pull" cap or a "screw" cap; to obtain these different types of closures, different and specific types of working need to be performed on the metal holder. The application of the "crown" cap and of the "ring-pull" cap requires the upper end of the metal holder to have an edge or collar, to be made by folding or turning outwardly the inner wall or surface of the opening.

However, the shape of the metal holder edge or collar that accommodates a "crown" cap is different from that for the application of the "ring-pull" cap; the making of the two different edges also entails a sequence of different operations to be performed on the holder and the application on the tapering machine of replacement tools and mandrels that are fit to work the top edge of the holders themselves. This requires longer machine tooling time with ensuing more or less extended machine downtime.

DISCLOSURE OF INVENTION

The object of this invention is to remedy the foregoing problem. More particularly, the object of this invention is to get ready a process and some apparatus to make an edge or a collar featuring a complex structure on extruded, deep-drawn and deep-drawn/wire-drawn metal rough pieces, basically but not critically upon holders made of aluminium or its alloys, in the type of beverage, food bottles or bottles for technical use, being such as to be able to be indifferently used both for the application, e.g. of either a "crown" cap or of a "ring-pull" cap.

A further object of this invention is to set up a process and some apparatus as outlined above, which are such as to be used on any tapering machine with which metal holders for the beverage or aerosol sectors are basically manufactured and with which also embossing/debossing actions are performed, these being actions that create on given areas of the side surface shaped marks, grooves and other patterns of various shape defined by hollow and/or embossed sectors.

Not last among the objects of this invention is to provide a system that does not demand tools to be replaced on the machine and guaranteeing flexibility at a high degree.

A further object of this invention is to make available to users a process that is fit to ensure a high quality level of the processed product and also such as to be easily and cheaply manufactured.

This and other objects are accomplished by means of a process and apparatus according to claims 1 and 11. Further advantageous characteristics make up the object of the independent claims.

BRIEF DESCRIPTION OF THE DRAWINGS

The process and apparatus of this invention are described hereinafter with reference to the attached drawings, wherein:

FIG. 14 is an axonometric projection of an optional device or mandrel fit to operate on the metal holder;

BEST MODE FOR CARRYING OUT THE INVENTION

According to the process and the apparatus of the invention, metal holders to be shaped at the upper end, to make the complex structure edge or collar that is meant to lodge the "crown" cap or the "pull-ring" cap, are fed in a known manner, for instance on the loading drum of a tapering machine.

The process to make an edge or a collar according to this invention includes a plurality of subsequent working stages as specified hereinafter.

Figure 1:
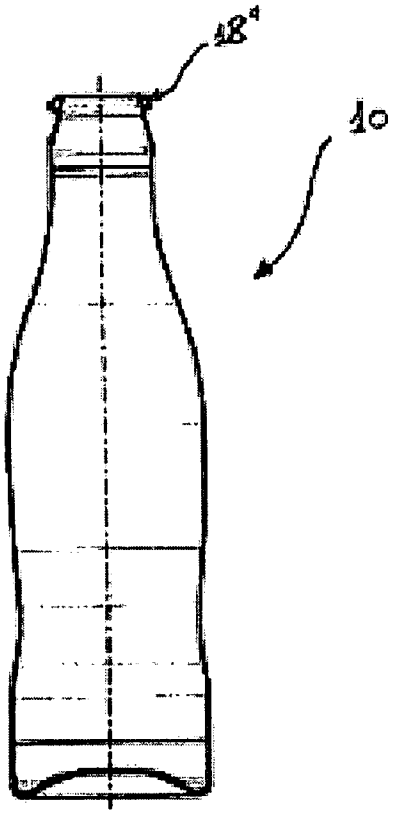
FIG. 1 is a schematic view of a section as to the vertical axis of a holder in the beverage style with the upper end shaped according to the process and the apparatus of this invention.
Figure 2:
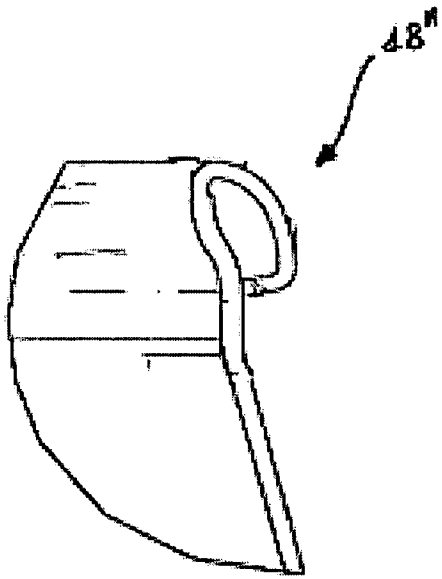
FIG. 2 is a schematic and sectioned view of the edge or collar obtained by using the top of the metal holder with the process and apparatus of this invention.

FIG. 1 schematically illustrates a metal holder referenced with 10, whose side surface has already undergone the deformation stage to achieve the beverage bottle shape and whose upper end has already undergone the process stages according to this invention to obtain an edge or collar 18" schematically illustrated in the enlarged detail view of FIG. 2.

Figure 3:
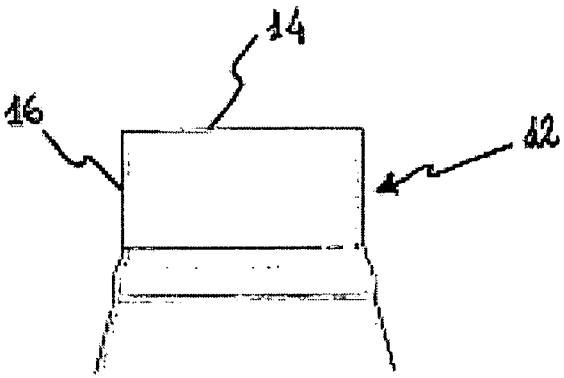
FIG. 3 is a schematic side view of the metal holder, that is of the rough piece that is ready to undergo the process described in this disclosure through the use of the dedicated apparatus.

FIG. 3 schematically illustrates a portion of the neck of the metal holder 10 in a state that precedes the deformation to achieve the edge or collar 18" fit to receive the closing cap, whether it be of the "crown" or the "pull-ring" type.

With reference to the above-mentioned figure, the portion of upper end of the metal holder 10 not yet deformed and referenced with 12 turns out to be basically cylindrical, thus defining a side surface 16 that extends parallel to the longitudinal axis of the holder itself.

This portion of upper end 12 of the metal holder 10, to allow the operating stages of the process dealt with in this invention to be carried out in an optimum manner, ranges between 0.1 and 1 mm, preferably between 0.3 and 0.5 mm, in thickness.

Figure 6:
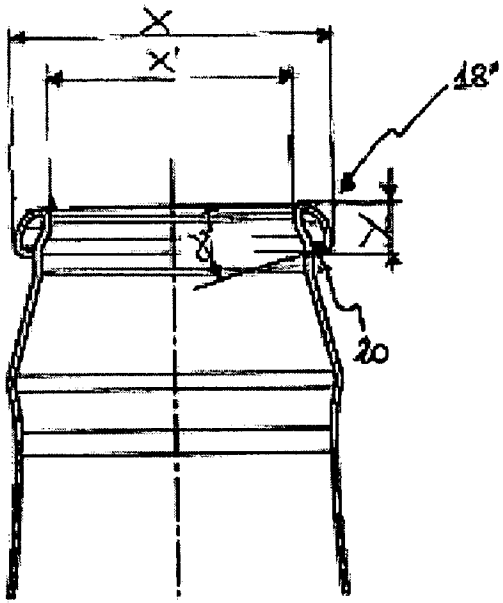
FIGS. 4, 5 and 6 are schematic side views of the progressive shape taken by the edge or collar of the metal holder at subsequent operating stages of the process of this invention.
Figure 5:
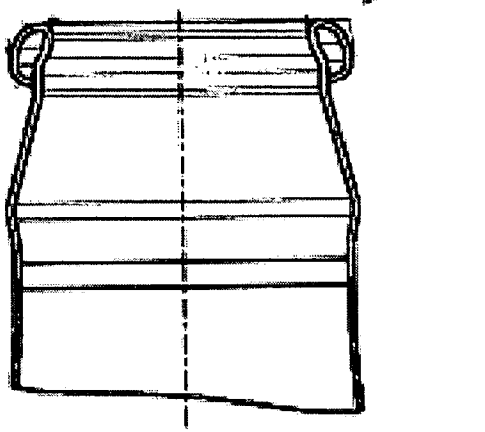
Figure 4:
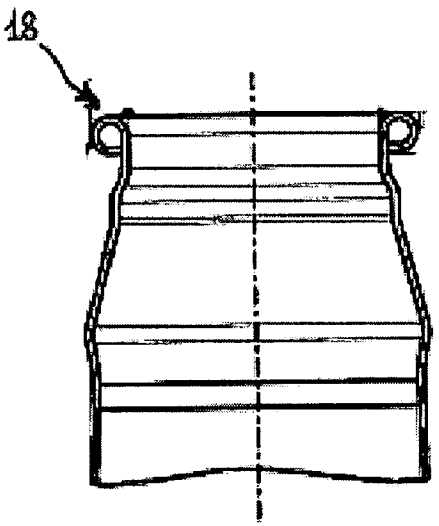

FIGS. 4, 5 and 6 schematically provide in a sequence the operating stages to deform the upper end portion 12 of the metal holder 10 according to the process of this invention. This metal holder 10 as shown in FIG. 3 is approached in a sequence, one after another, by a plurality of tools or mandrels, making up the apparatus dealt with in this invention, about which more will be said hereinafter, these tools being arranged, according to a preferential embodiment, on the shifting plate of the tapering machine. These tools progressively rise above or fit, at least in part, the mentioned metal holders along at least a part of the side surface starting from the upper end portion 12. The conjunction of the axial motion, defined by the alternating rectilinear displacement of the shifting plate, and of the rotational movement of mandrels causes the deformation of the upper end portion 12 of the metal holder 10 to the desired shape.

The process of this invention, in its preferential embodiment, includes a starting operating stage during which the upper end portion 12, initially cylindrical, as depicted in FIG. 3, is folded back or turned outwardly by an angle of at least 270° so as to obtain an edge or collar 18 with a basically circular section.

The shaping of the upper end of the metal holder 10, with the upper end portion 12 folded outwardly so as to form the collar 18, as shown in FIG. 4, is followed by one or more additional intermediate operating deformation stages, as illustrated in FIG. 5.

In this figure, the action of the tools or mandrels, making up the apparatus that will be described hereinafter, on the collar 18 of the metal holder 10 illustrated in FIG. 4, causes a squeezing of the latter in the radial direction, towards the axis of the metal holder 10, and its simultaneous stretching towards the bottom of the metal holder itself. The collar thus obtained, referenced with 18' in FIG. 5, is basically ellipsoidal shaped.

According to the invention the process also includes a final operating stage affecting the collar 18' of FIG. 5 which, after the mentioned final operating stage, takes on the basically ovoidal shape identified by reference 18" in FIG. 6. The dimensioning of this edge or collar 18" defines an outer diameter X and an inner diameter X' which are respectively calculated close to the maximum extension point of the collar and by making reference to the inner surface of the opening whereupon the collar is obtained.

The outer diameter X ranges between 25 and 28 mm and preferably between 26 and 27 mm whereas the inner diameter X' ranges between 19 and 22 mm, and preferably between 20 and 21 mm. The edge or collar 18" also defines a height Y, ranging between 2.5 and 5 mm, and preferably between 3 and 4 mm; this height Y is calculated with reference to the distance between the plane that defines the opening of the metal holder and the theoretical plane beneath matching the collar itself in the lower portion folded towards the side surface of this metal holder.

The edge or collar 18" also includes an end portion 20, folded towards the opening of the metal holder, with a linear and inclined course, as to the plane of the metal holder 10 opening, by an angle ($\alpha$) ranging between 5 and 150 and preferably ranging between 8 and 120.

The tools or mandrels, which will be described hereinafter, that are used for the above-mentioned final operating stage also simultaneously carry out a finishing stage of the external surface of the edge 18" in order to obtain an edge that is free from defects that might irritate anybody bringing the metal body 10 to his mouth in order to drink. This finishing operation defines for the external surface of the edge or collar 18" a finishing degree that basically equals 0.2 μm at least.

The operating stages that are described above in full detail are preceded by a stage of removal of the material from the upper end portion 12 of the metal holder 10. This operating stage is defined by the removal of material from a head surface 14, fit to make regular and smooth down the opening of the holder 10 and by any removal of material from the side surface 16. The mentioned removal of material from the side surface 16 is aimed at obtaining, for the upper end portion 12 of the metal holder 10, a thickness value ranging between 0.1 and 1 mm, preferably between 0.3 and 0.5 mm, useful for the following deformation operations.

The number of operating stages affecting the process of this invention is a function of the complexity of the edge or collar 18" to be made and of the characteristics of the material making up the metal holder.

Figure 10:
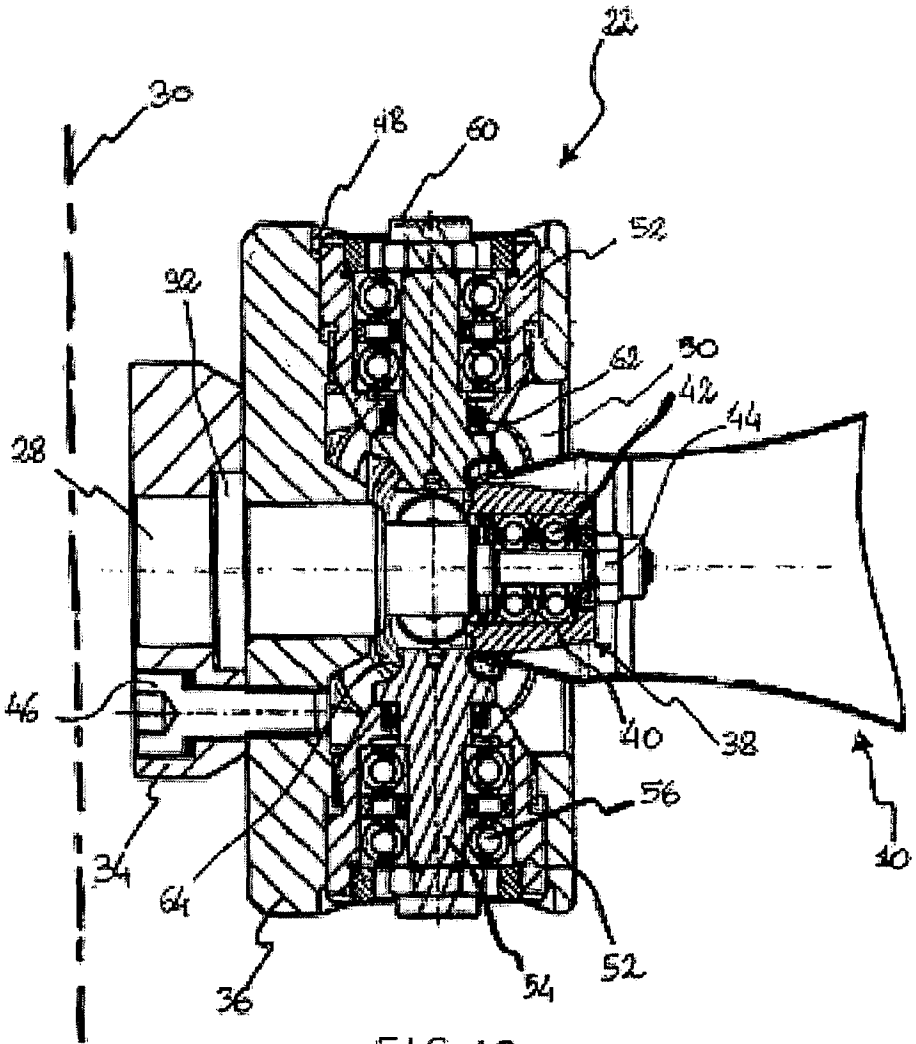
FIG. 10 schematises a longitudinal section view of the device or deformation mandrel of the previous figure.
Figure 9:
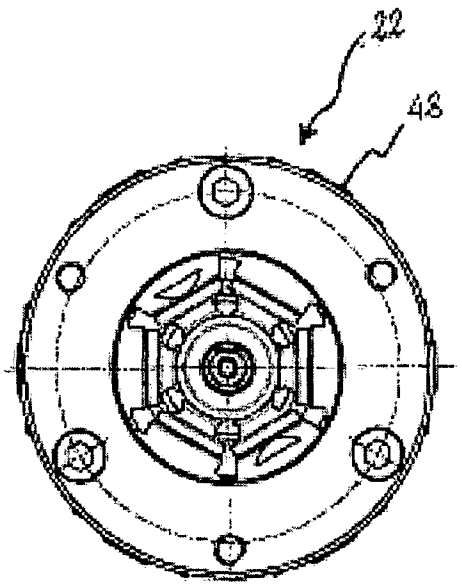
FIG. 9 is a plane and schematic view of one of the devices or deformation mandrels of the apparatus of this invention.
Figure 11:
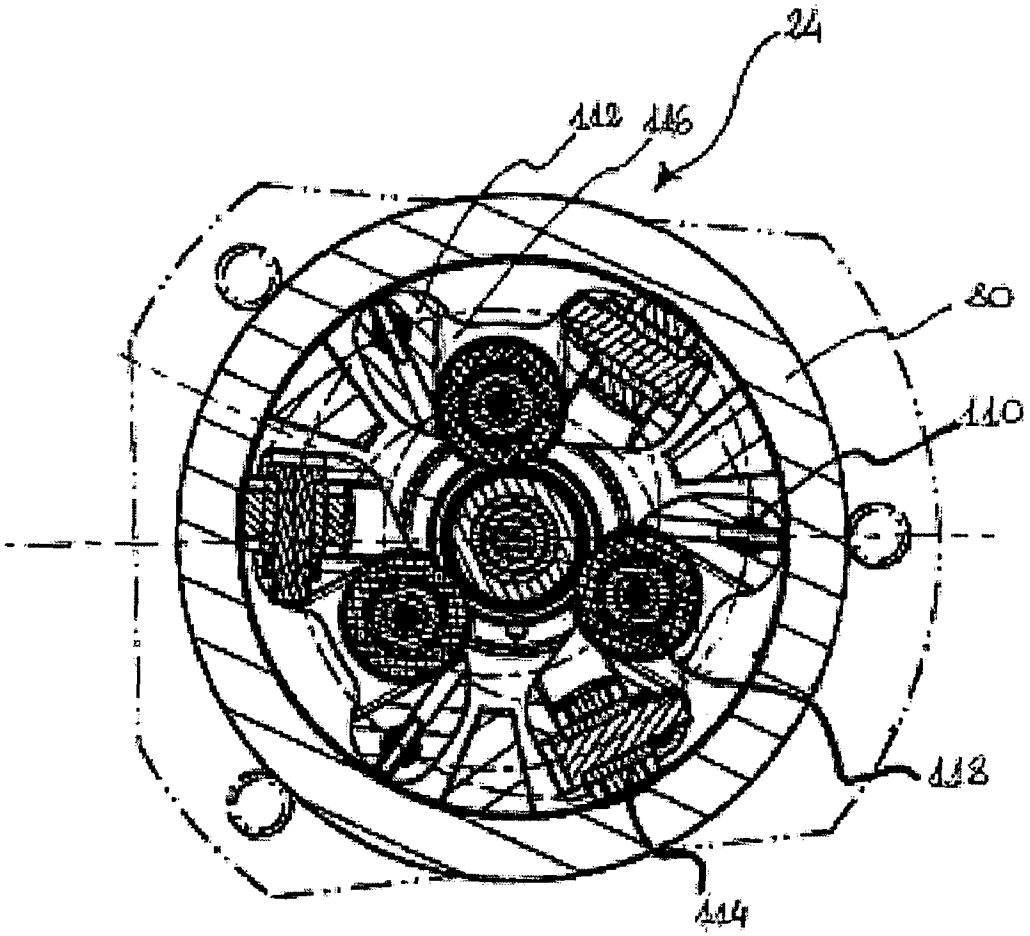
FIG. 11 is a plane and schematic view of a further device or deformation mandrel of this invention.
Figure 12:
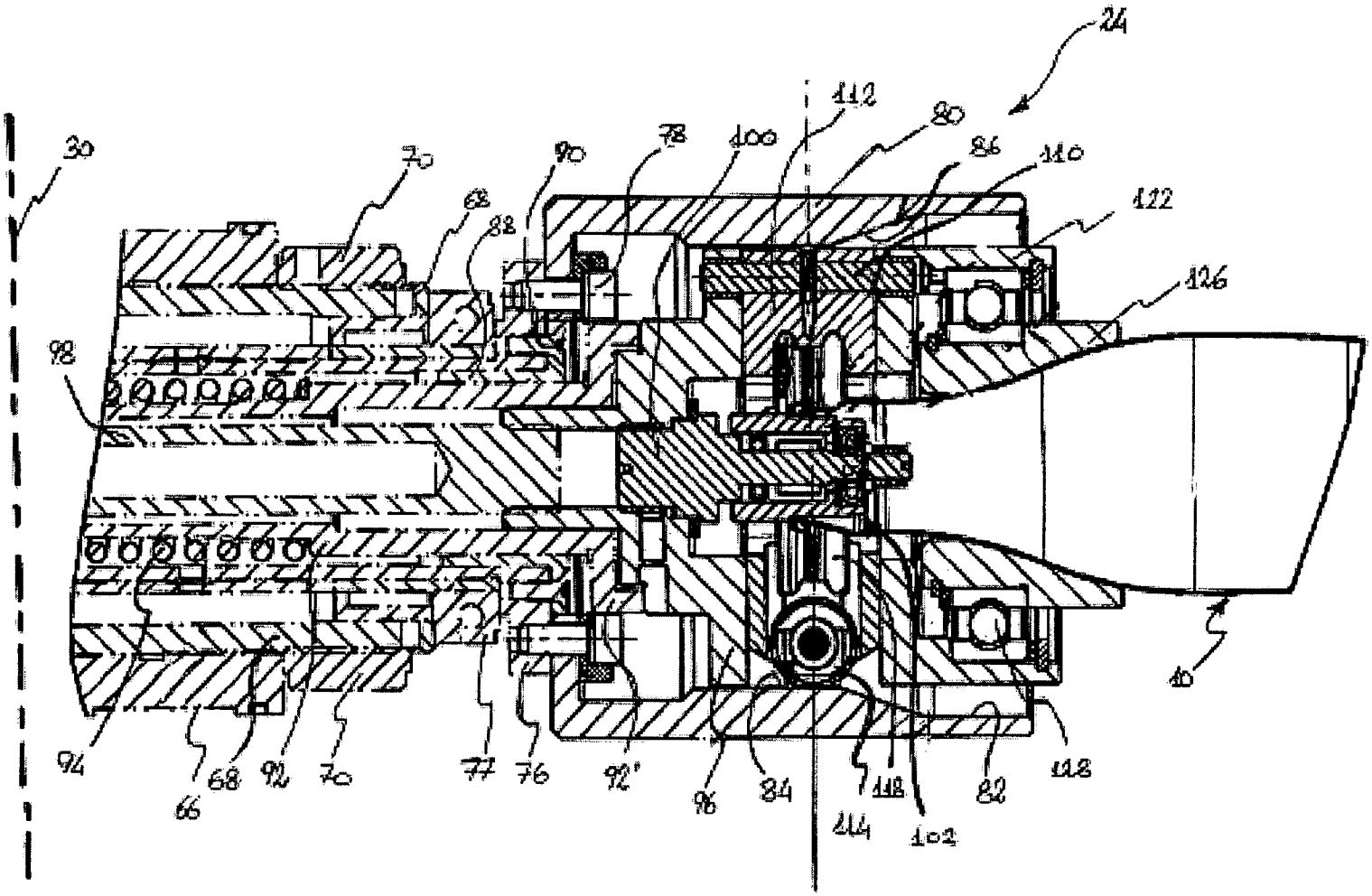
FIG. 12 is a schematic longitudinally sectioned view of the device or mandrel of FIG. 11.
Figure 13:
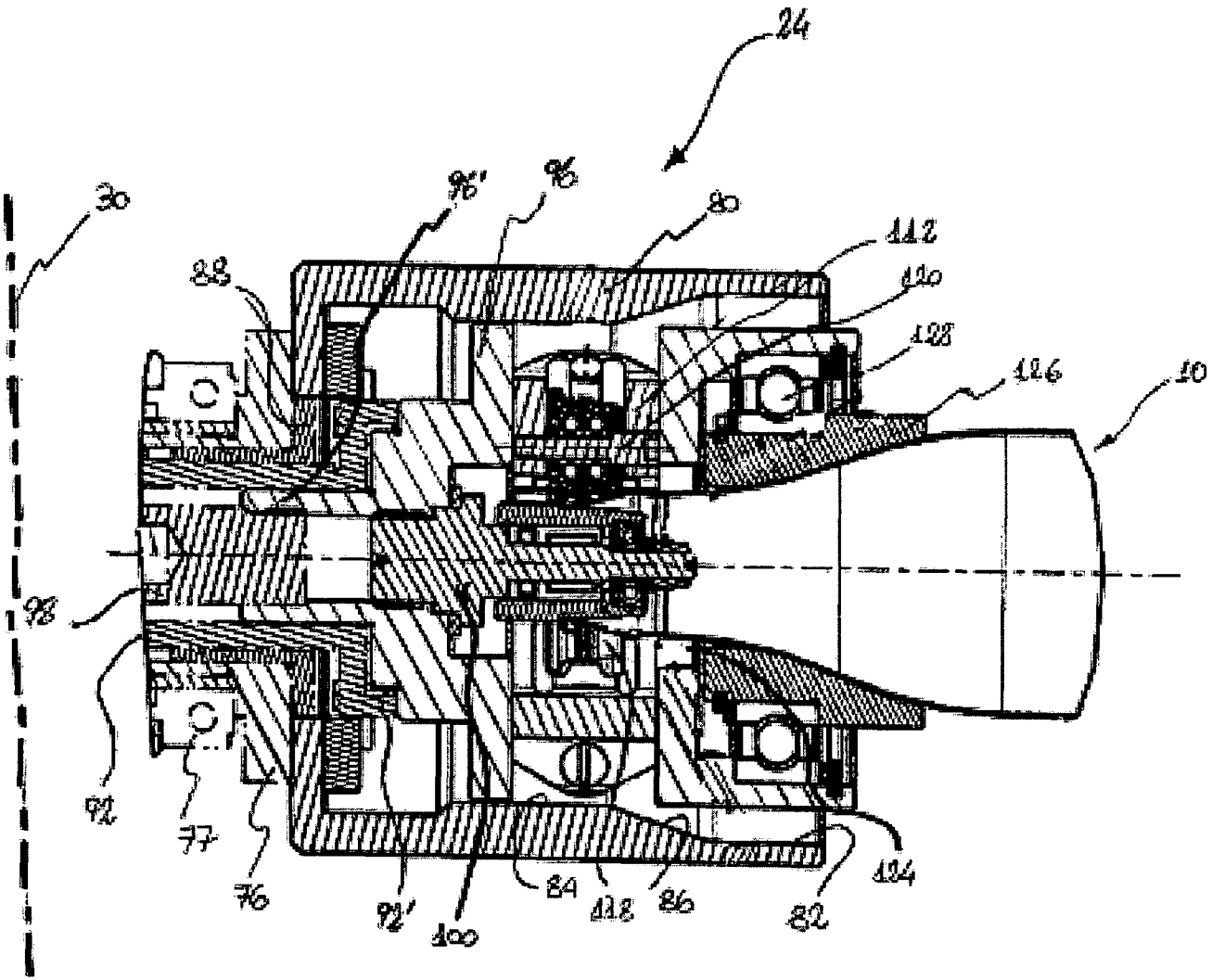
FIG. 13 is a further schematic view of a section according to another longitudinal plane of the device or mandrel of FIG. 11.
Figure 44:
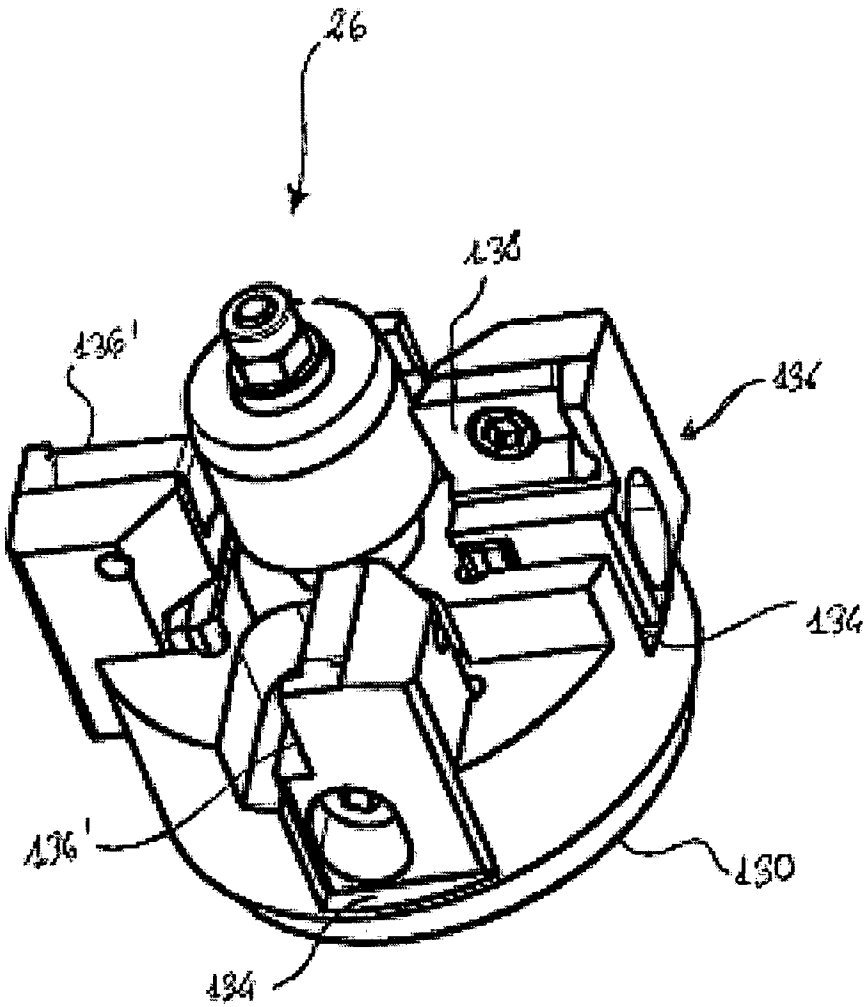
Figure 15:
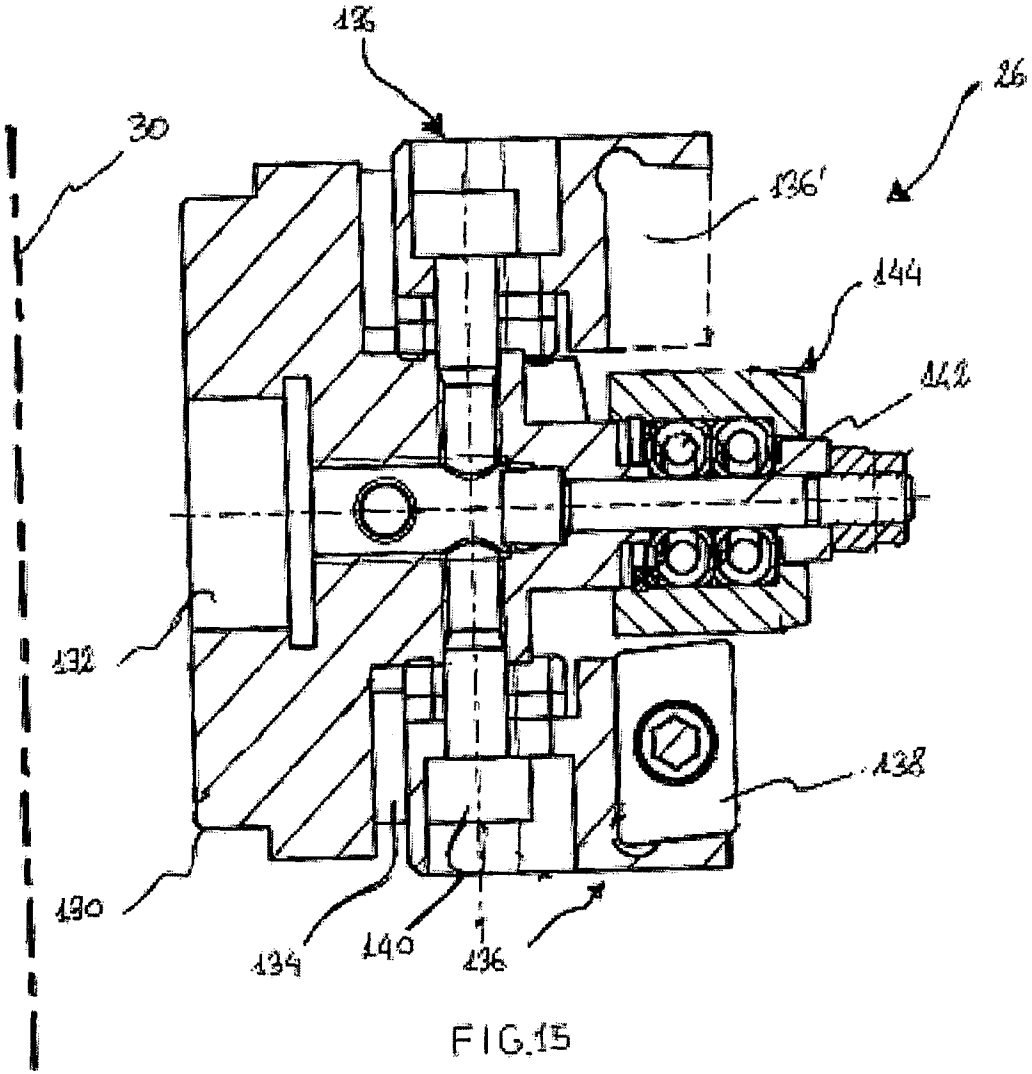
FIG. 15 schematises a longitudinal section of the optional device or mandrel of the previous figure.
Figure 16:
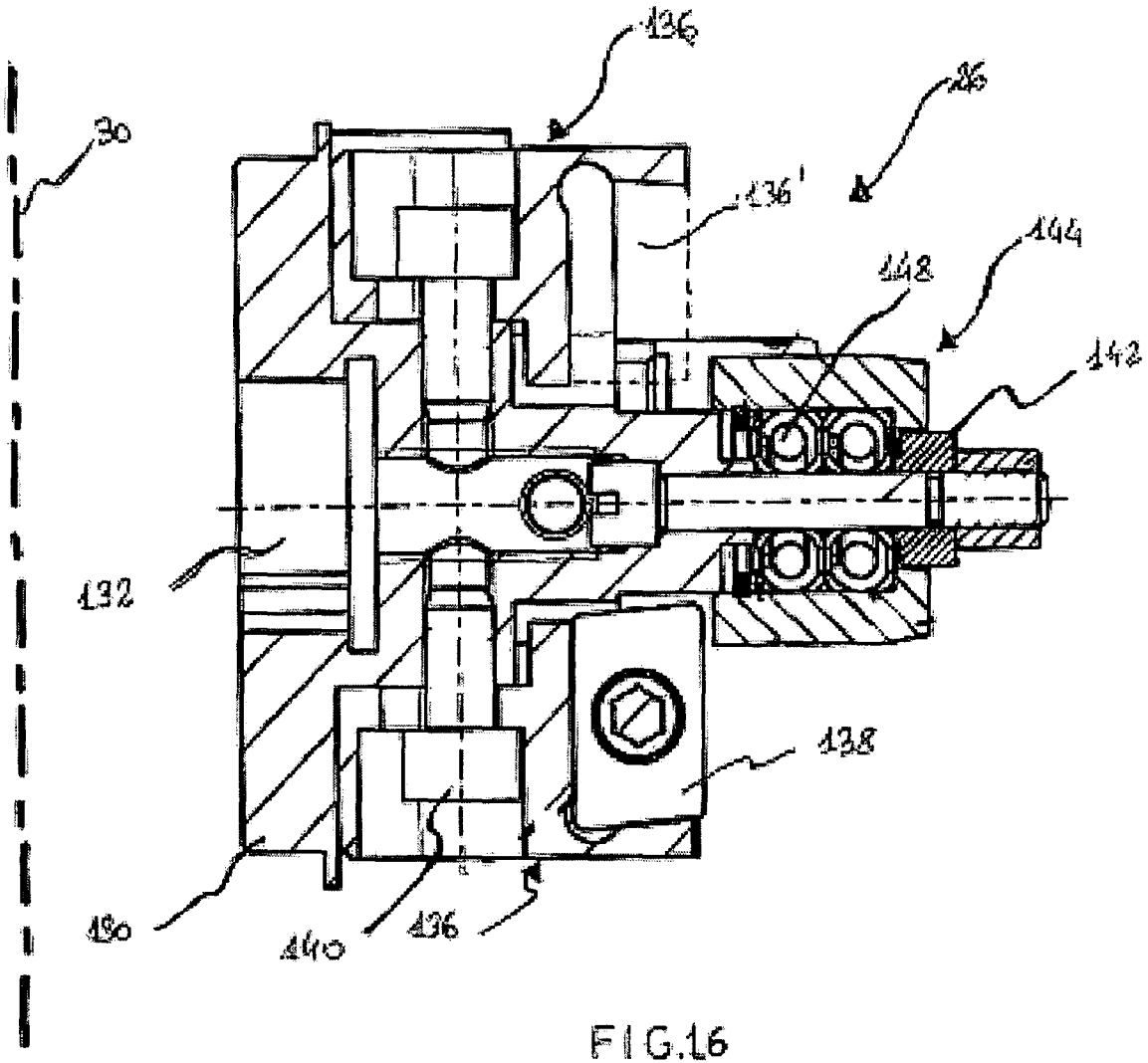
FIG. 16 schematises a longitudinal section according to a different diametral plane of the optional device or mandrel of FIG. 14.

The apparatus to execute the process, which is fully described above in its operating stages, includes one or more mandrels, referenced with number 22, in FIGS. 9 and 10, with number 24 in FIGS. 11, 12 and 13 and with number 26 in FIGS. 14, 15 and 16.

The mandrel 22 or the edging mandrel of FIGS. 9 and 10 is formed by a rotating shaft 28, featuring a basically cylindrical section, with diversified diameters and with the rear end turned, in the preferential embodiment, e.g. towards a shifting plate 30, which is schematically identified by a hatched vertical line in FIG. 10. This rear end of the rotating shaft 28 is equipped with means that are already per se known, not shown in the figure, which allow for quick connection and release (in case of tool replacement) of the mentioned rotating shaft with reference to the driving unit or to the movement transmission components, not shown either, which are located on the shifting plate 30 of a tapering machine and which give motion to the rotating shaft itself.

The mentioned rotating shaft 28 is equipped, close to the rear end, with a ring piece 32, which defines a striking surface for the same rotating shaft as to a base or plate 34 and to a body 36 of which more will be said hereinafter.

Keyed to a portion of the front end of the rotating shaft 28, turned e.g. towards a rotating table (not shown in the figure) where the metal holder 10 is blocked, is a centering device 38, which includes a element 40, in the shape of a "bowl" with a basically conehead section co-operating with one or more bearings 42, of traditional type, arranged within and fitted out on the very front portion of the rotating shaft 28. This centering device 38 is also constrained to the front end of the rotating shaft 28 with known means, such as for instance a nut 44 or a pin. The bearings 42 that are fitted out on the rotating shaft 28 allow the member 40 to rotate freely as to the rotating shaft itself in a manner that will be indicated hereinafter.

Keyed to the rotating shaft 28 is also the body 36, arranged with its lower side into contact with the front side of the ring piece 32 and with the front side of the base or plate 34. The very body 36 and the base or plate 34 are also rigidly connected to one another by means of screws 46 or equivalent means.

The body 36, typically made of metal, is preferably cylindrical in the shape of a "bucket" and is equipped, along the side surface, of at least two openings 48 featuring a basically circular section being diametrically opposed to and equidistant from one another. The body 36, on the front side, turned towards the rotating table, presents a further opening 50 preferably circular shaped, fit for introducing the metal holder 10 to be processed.

Within each opening 48 of the body 36 and coaxially to the opening a support 52 is located, which makes up the seat of a pivot 54 co-operating with one or more bearings 56, arranged inside the support 52 and fitted out on the pivot 54. This support 52 is constrained as to the opening 48 e.g. by means of a threaded connection or a connection of another sort and also such as to allow the same support to be adjusted in axial position.

The pivot 54, at the rear end, is blocked as to the bearings 56 by screws 60 or equivalent means and, close to the front end of the support 52 turned to the centre of the body 36, is equipped with one or more grommets 62 coaxial to the pivot itself. The front end of the pivot 54, located towards the centre of the body 26, presents a portion 64 of the side surface shaped as a function of the type of edge or collar to be made on the metal holder 10 in a manner that will be indicated hereinafter.

The operation of the edging mandrel 22, fully described above in its component parts, is explained below.

The metal holder 10, which is blocked in a known manner as to the rotating table, after reaching the work station identified by the edging mandrel 22, is configured as schematically illustrated in FIG. 3, that is with an upper end portion 12 not yet deformed and with a basically cylindrical course extended parallel to the longitudinal axis of the metal holder itself.

The rotating shaft 28 of the edging mandrel 22 is always rotating around its axis and pulls along in its rotation the components that are connected to it, that is the base or plate 34 and the body 36. The pivots 54, however, are idle and rotate freely as to the rotating shaft 28 according to an axis that is perpendicular to that of the shaft itself; also the centering device 38 is free to rotate around the axis of the bordering mandrel 22.

The axial feed movement of the shifting plate 30, where the edging mandrel 22 is fastened to, takes the mandrel itself to be fitted out on the metal holder 10 and simultaneously brings about the insertion of the centering device 38 into the metal holder itself partly matching its inner surface. The centering device 38 thus inserted allow the metal holder 10 to be made coaxial with the edging mandrel 22 and simultaneously supports the metal holder itself, by its inner portion, during the working performed by the mandrel 22. The centering device 38 which, as already said above rotates idly as to the rotating shaft 28 to which it is keyed, once it is inserted into the metal holder 10, prevents a torque to be transmitted to the metal holder that is blocked as to the rotating table.

At the same time as the centering device 38 is inserted into the metal holder 10, the forward feed movement of the shifting plate 30 and hence of the edging mandrel 22 forces the upper end portion 12 of the metal holder 10 to come into contact with the portion 64 of the side surface of the pivot 54. The shaping of this portion 64 of the side surface of the pivot 54, along with the forward feed and rotation movement of the edging mandrel 22, causes the inner wall or surface of the opening of the metal holder 10 to fold outwardly so as to first create the edge or collar 18 and, later or simultaneously, the edge or collar 18' as schematically illustrated in FIGS. 4 and 5.

It is understood that the edging mandrel 22, which creates the edge or collar 18 in a manner that is typical of the starting operating stage as described above, is similar to the one that creates the edge or collar 18' in the one or more intermediate operating stages, with the sole difference that the portion 64 of the side surface of the pivot 54 is shaped differently as a function of the different pattern of the edge or collar 18 and 18'.

When the side surface portion 64 of the pivot 54 comes into contact with the upper end portion 12 of the metal holder 10 and the mentioned upper end portion 12 folds to form the edge or collar, as a consequence of the friction resulting from the contact between the above-mentioned side surface portion 64 of the pivot 54 and the metal body 10, the pivot 54 itself starts rotating according to an axis that is perpendicular to that of the rotating shaft 28 of the edging mandrel 22. This rotation advantageously prevents all rolling process from possibly affecting the external surface of the metal holder 10 edge or collar.

With reference to FIGS. 11, 12 and 13, the apparatus that is dealt with in this disclosure also comprises one or more rolling mandrels 24 as described below.

The rolling mandrel 24 consists of a body that is basically cylindrical which includes a first sleeve 66 and a first tubular body 68 that is placed coaxially as to the first sleeve 66 and fastened to, as to the latter first sleeve 66 e.g. by means of a threaded nut 70.

Inside the first tubular body 68 a flanged sleeve 76 is located in an axial direction with the flange formed on its front end and turned towards the rotating table whereto the metal holder 10 is constrained. The mentioned flanged sleeve 76, while rotating, is supported in a known manner, e.g. resting on one or more bearings 77.

To the front end of the flanged sleeve 76 a cylindrical body 80 is fastened to with screws 78 or equivalent means; this cylindrical body 80, in the shape of a "bowl", presents, along the inner side, two adjoining surfaces 82 and 84 featuring diversified diameters. In particular, the surface 82, turned towards the external part of the cylindrical body 80 and in the direction of the rotating table, has a larger diameter than the surface 84 behind, which is located in the intermediate portion of the cylindrical body itself. This surface 82 is linked up with the surface 84 by means of an angled curtail riser 86. The inner side of this cylindrical body 80 hence defines a cam whose function will be described hereinafter.

A cylindrical support 88 is located inside the flanged sleeve 76 and is fastened to its flange through screws 90 or equivalent means. Inside the above-mentioned cylindrical support 88 a third sleeve 92 with diversified diameters is located.

The mentioned third sleeve 92, next to its rear portion, defines the seat where an elastic component, like e.g. a helical spring 94, is fitted out. Again this third sleeve 92, next to its front side turned towards the rotating table and inside the cylindrical body 80, presents an extension 92' that is cylindrical in shape which extends along a limited length towards the rotating table starting from the front side of the sleeve itself.

This extension 92' of the third sleeve 92 receives a flanged support 96 from whose lower side, overlooking the third sleeve 92, a tubular appendage 96', which enters the third sleeve 92, extends.

Starting from the rear end of this tubular appendage 96' of the flanged support 96 a shaft 98 is inserted, this being fastened to the tubular appendage itself by means of a threaded connection or a connection of another known type. Inside the flanged support 96, on the opposite side as to that of insertion of the shaft 98, a shaped pivot 100 is fastened to by means of a threaded connection or a connection of equivalent type.

This shaped pivot 100 presents, on the front portion and oriented towards the rotating table, a portion with smaller diameter making up the keying location of a centering device 102, whose function will be described hereinafter. This centering device 102 is thoroughly similar to the one described beforehand in connection with the edging mandrel 22.

On the front side of the flanged support 96 a plurality of levers 112 is pivoted, e.g. by means of a pin or pivot 110. On the free end of each of the foregoing levers 112 a disc or roller 114 is constrained, this roller matching the surfaces 82 and 84 with diversified diameters of the cylindrical body 80. Each of the foregoing levers 112, as illustrated in FIG. 11, in the intermediate portion of the longitudinal section, defines a seat 116 to receive a wheel or shaped roll 118, equipped along a surface that is parallel to the axis of rotation of the rolling mandrel 24 of a hollow or groove that is shaped as a function of the edge or collar to be made on the metal holder 10. These wheels or rolls 118 are constrained to the levers 112, e.g. by means of pivots 120. These levers 112 are held open, with the disc or roller 114 matching the surface 82 of the cylindrical body 80, due to the action of the centrifugal force produced by the rotation of the rolling mandrel 24 and hence the flanged support 96 where the levers 112 are fastened to, around their own axis.

Moreover, the levers 112 are located between the flanged support 96 and a holding body 122 in the shape of a "bucket", of limited height and preferably circular in section, with the lower base, oriented towards the levers 112, equipped with a central opening 124, fit to allow the metal holder 10 to be introduced. This holding body 122 is arranged coaxially to the flanged support 96.

Inside the holding body 122 and coaxially to it, a contrast 126 preferentially cylindrical shaped, is located whose inner surface is shaped as a function of the type of metal holder 10, co-operating with bearings 128 of traditional type, which allow it to rotate freely as to the very holding body 122.

The contrast 126 aims at wrapping the outer surface of the metal holder 10 so as to ensure its correct axial position as to the rolling mandrel 24.

The operation of the rolling mandrel 24, described above in full detail, is defined hereinafter.

The metal holder 10, after undergoing a plurality of operating stages accomplished by the edging mandrels 22 previously described, engages the rolling mandrel 24 for the final operating stage that brings about as final result the accomplishment of the edge or collar 18", depicted in FIG. 2, on the opening of the metal body itself.

The shaft 98 of the rolling mandrel 24 is always rotating and with it even the other associated components rotate, such as the flanged support 96, the shaped pivot 100 with the centering device 102, the levers 112, the holding body 122 and the contrast 126; moreover, when the rolling mandrel 24 is not fitted out on the metal holder 10, the discs or rollers 114 match the surface 82 of the cylindrical body 80.

When, during the final operating stage of the foregoing procedure, the rolling mandrel 24 is fitted out on the metal holder 10, the feeding movement of the shifting plate 30 forces the contrast 126 to embrace the metal holder and, at the same time, the centering device 102 enters the opening of the same metal holder and meets the inner surface. The contrast 126 and the centering device 102, thus arranged as to the metal holder 10, do not rotate with the rolling mandrel 24 thus avoiding the transmission of a torque onto the metal holder itself.

Owing to the feeding movement of the shifting plate 30 whereto the rolling mandrel 24 is fastened to and hence to the pressure exerted on the metal holder 10, the flanged support 96 withdraws thus causing the compression of the helical spring 94 and the discs or rollers 114 matching the surface 84 of the cylindrical body 80. Thus, the levers 112, pivoted as to the flanged support 96, turn to the centre of the cylindrical body 80 and force the wheels or shaped rolls 118 to clamp onto the edge or collar of the metal holder 10. These wheels or shaped rolls 118 that turn around its axis and are also pulled along in the rotation motion of the rolling mandrel 24 thus bring about the final shaping and the surface finishing of the edge or collar of the metal holder according to the configuration marked with 18" in FIG. 2.

When the rolling mandrel 24 has accomplished its own operating stage, the shifting plate 30 withdraws, the mandrel 24 disengages from the metal holder 10 and the helical spring 94, previously compressed, moves back to the resting position thus forcing the discs or rolls 114 to meet the surface 82, which causes the wheels or shaped rolls 118 to detach from the edge or collar 18" of the metal holder itself.

The devices to make an edge or collar on extruded metal rough and drawn pieces also include one or more mandrels 26, schematically illustrated in FIGS. 14, 15 and 16, of which a detailed description is provided hereinafter. These mandrels operate the optional thickness reduction stage of the upper end portion 12 of the metal holder 10 previously described.

The mandrel 26 consists of a tang 130 with diversified diameters, preferably cylindrical shaped, on whose lower side, oriented in the direction of the shifting plate 30, an opening or hole 132 is formed, this being fit to receive a rotating shaft or a mandrel-holder (not depicted in the figures), fastened to the shifting plate 30 and fit to make the mandrel 26 rotate to perform the function that will be explained hereinafter.

On the side surface of the same tang 130, in a radial and equidistant position from one another, two or more pairs of opposed pockets 134 are made, which define the lodging seat of a plurality of insert-holding supports 136, which in the central-upper area of the side surface present a levelling 136'. This levelling, starting from the central area of the side surface of the insert-holding support 136, develops in the direction of the end base of the insert-holding support itself from the side that is oriented towards the rotating table where the metal holder 10 is fastened to. The levelling 136' of the insert-holding support 136 defines the seat to receive bits or edges 138, of traditional type, quadrangular or in another known shape, fastened to the insert-holding support itself through a connection of mechanical type, such as dowels, screws or lock joints, or through another known fastening type.

The insert-holding supports 136 are located and constrained in the pairs of opposed pockets 134 e.g. by means of screws 140 or another equivalent means. The mentioned insert-holding supports 136 can be adjusted both in the radial and in the axial direction by acting on the screws 140 to accomplish a function that will be described hereinafter.

On the front side of the tang 130, in the direction of the rotating table as to which the metal holder 10 is fastened to, a centering device 144 similar to those described beforehand for the edging mandrel 22 and for the rolling mandrel 24 is keyed, e.g. on a pivot or a screws 142.

The mandrel 26, fastened to a shaft or to a mandrel-holder of the shifting plat 30, is set to rotate around as to its own axis and from the same shaft or mandrel-holder itself, following the forward feeding movement of the shifting 30, engages the metal holder 10 with the centering device 144 that meets the inner surface of the upper end portion 12. The mandrel 26 works on the upper end portion 12 of the metal holder 10 at an operating stage, which is preliminary and/or optional as to the operating stages previously described to obtain the edge or collar 18", thus performing, in a simultaneous or sequential manner, a removal of material from the upper edge 14 and possibly a reduction in thickness of the side surface 16 of the same upper end portion. This simultaneous or sequential working of the upper edge 14 and of the side surface 16 is advantageously obtained by adjusting the insert-holding supports 136, inserted in the pairs of opposed pockets 134, according to different axial and radial positions, as depicted in FIGS. 15 and 16.

During the foregoing processing, the centering device 144, which is not pulled along in the mandrel rotation 26, guarantees the coaxiality of the metal holder 10 as to the optional mandrel 26 and avoids the transmission of a torque to the metal holder itself.

The number of mandrels forming the apparatus of this invention varies as a function of the complexity of the edge or collar one wishes to make and hence of the number of operating stages defined by the foregoing process.

As one may understand from the foregoing disclosure, the advantages brought by the invention are clear.

Figure 8:
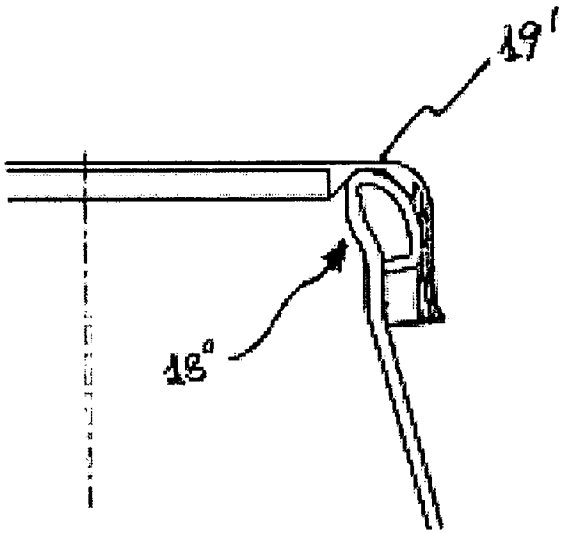
FIG. 8 is a schematic sectioned view of the same edge or collar of the metal holder on which a "crown" cap is placed.
Figure 7:
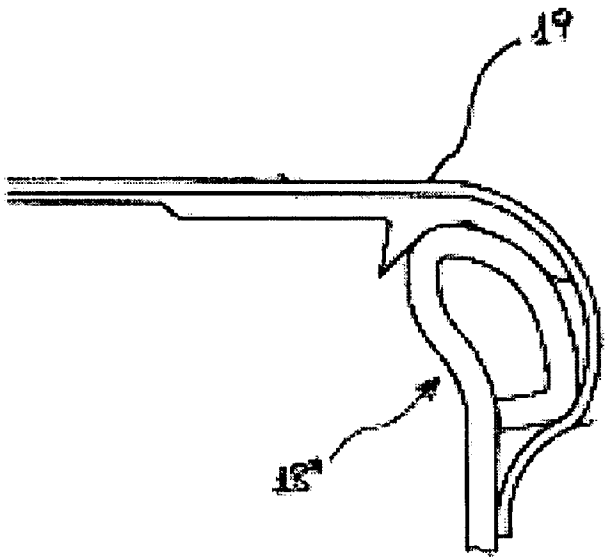
FIG. 7 is a schematic and sectioned view of the edge or collar manufactured according to the process and by using the apparatus of the invention, on which a cap of the "ring-pull" type is fitted.

The process and apparatus for making an edge or a collar 18" featuring a complex structure on extruded, deep-drawn and deep-drawn/wire-drawn metal rough pieces of this invention, applied to metal holders, made of aluminium or its alloys, in the shape of beverage or food bottle or for technical use, advantageously allows an edge or collar to be obtained whereto either the "ring-pull" or the "crown" cap applies without distinction, as respectively marked in FIGS. 7 and 8 with reference numbers 19 and 19', as well as any other type of cap demanding, for its application, the making of an edge or collar featuring a profile with a complex and multiple curvature.

A further advantage of this process and of the apparatus of the invention is in that the process and the apparatus can be used on all tapering machines with which metal holders for the beverage or aerosol sectors are typically obtained and through which also embossing/debossing actions are performed.

Although the foregoing invention has been described above with special reference made to one embodiment, which has only been provided as an example and shall not be meant to be restrictive in character, several variations and changes will be clear to anyone skilled in the art in the light of the foregoing description. Therefore, this invention is meant to embrace all those modifications and variations that fall under the object and the scope of the appended claims.

The invention claimed is:

1. A method for forming an edge or collar at the open end of a metal holder defined by an extruded metal rough piece, deep-drawn or deep-drawn/wire-drawn, adapted to form bottles for beverage and food sectors or for technical use wherein the method can be carried out on a tapering machine, said metal holder adapted to be closed by a cap, said method includes in sequence:

a first operating deformation stage of a basically cylindrical upper end portion (12) of said metal holder (10), turning it outwardly so as to obtain an initial stage collar (18) with a basically circular cross-section;

a second intermediate deformation stage performed on said initial stage collar (18) squeezing it in the radial direction and stretching it towards a bottom of said metal holder (10) to form a second stage collar (18'); and a third deformation stage performed on said second stage collar (18') to form a final stage collar (18") with a complex ovoidal profile, whereby said profile is adapted to allow at least two caps of different type to be applied to said metal holder (10);

wherein said first operating deformation stage and said second intermediate deformation stage are accomplished by an edging mandrel (22) and said third deformation stage is accomplished by a rolling mandrel (24) both provided with axial movement and always rotating and intervening sequentially on the metal holder, said edging mandrel comprising pivots (54) and a centering device (38) inserted in the metal holder for supporting the metal holder and the rolling mandrel (24) comprising shaped rolls (118) and a centering device (102) inserted in the metal holder for supporting the metal holder, with the surface of the pivots (54) and shaped rolls (118) shaped as a function of the type of the edge or collar to be formed.

2. The method according to claim 1, wherein the third operating stage includes a finishing of the final stage collar (18") surface.

3. The method according to claim 1, wherein prior to said first stage a preliminary reduction in thickness of a side surface (16) of an upper end portion (12) of the metal holder (10) is made.

4. The method according to claim 1, wherein in the first operating stage an upper end portion (12) of the metal holder (10) is folded back or turned outwardly by an angle of at least 270°.

5. The method according to claim 1, wherein one or more intermediate operating stages are provided which, through the squeezing of the initial stage collar (18) in radial direction and its simultaneous stretching towards the bottom of the metal holder (10), the second stage collar (18') is formed with an ellipsoidal shape.

6. The method according to claim 1, wherein the ovoidal final stage collar (18"), formed during the third deformation stage, defines:

an outer diameter (X), calculated close to a maximum extension point of the collar with a value in the range between 26 and 27 mm and an inner diameter (X') calculated with reference to an inner surface of the opening whereupon the edge or final stage collar (18") is obtained and whose value is in the range from 20 to 21 mm;

a height Y, which is calculated as to a distance between a plane that defines an opening of the metal holder and a theoretical plane beneath matching the collar in the lower portion folded towards the side surface of the metal holder, the value of this height in the range between 3.5 and 0.4 mm;

an end portion (20) of the final stage collar (18") that is folded towards the opening of the metal holder (10) with a linear and inclined course, as to the plane of the metal holder opening, by an angle ($\alpha$) in the range between 8 and 12°.

7. The method according to claim 1, wherein an external surface of the final stage collar (18") of the metal holder (10) has a finishing degree not less than 0.2 μm.

8. The method according to claim 1, wherein a thickness of a side surface (16) of an upper end portion (12) of the metal holder (10) is brought to a value that ranges between 0.3 and 0.5 mm.

9. The method according to claim 1, wherein the at least two caps of different type are a crown cap and a ring-pull cap.

10. The method according to claim 1, which includes a further mandrel (26) adopted to remove material along a side surface (16) of an upper end portion (12) of the metal holder (10).

11. An apparatus for performing the method according to claim 1, wherein said edging mandrel (22) is composed of a rotating shaft (28) with differentiated diameters whereon a body (36) is solidly keyed with a basically cylindrical bucket shape and equipped along a side surface of at least two openings (48) featuring a circular section diametrically opposed to and equidistant from one another.

12. The apparatus according to claim 11, wherein inside each opening (48) of the body (36) of the edging mandrel (22) and coaxial to each opening a support (52) is located which defines the seat to receive the pivot (54) co-operating with one or more bearings (56) arranged inside within the support (52) and fitted out on the pivot (54).

13. The apparatus according to claim 12, wherein the pivot (54) at the front end oriented towards the body centre (36) of the edging mandrel (22) presents a side surface portion (64) that is shaped as a function of the type of collar to be formed on the metal holder (10) and, at the rear end, is blocked as to the bearings (56) with screws (60).

14. The apparatus according to claim 11, wherein on a front end portion of the rotating shaft (28) of the edging mandrel (22) turned in a direction of a rotating table, the centering device (38) is keyed constrained to a front end of the rotating shaft (28) with a nut (44), this centering device comprising a component (40) in the shape of a bowl with a section basically cone-shaped and co-operating with a bearing (42) arranged inside and fitted on the front end of the rotating shaft (28).

15. The apparatus for performing the method according to claim 1, wherein the rolling mandrel (24) is formed, in the portion that overlooks a shifting plate (30), by a first sleeve (66), by a tubular body (68) of smaller dimension as to the first sleeve (66), coaxially inserted into the first sleeve (66) and fastened to it by means of a threaded nut (70), inserted in the first tubular body (68).

16. The apparatus according to claim 15, wherein the rolling mandrel (24) includes a flanged sleeve (76) with the flange formed on a front end and oriented towards a rotating table whereto the metal holder (10) is constrained, arranged inside and coaxially to the first sleeve (66) and supported while rotating through a bearing (77).

17. The apparatus according to claim 16, wherein on the front side of the flanged sleeve (76) of the rolling mandrel (24) a cylindrical body (80) shaped as a bowl is fastened with screws (78) which defines, along an inner front, two adjoining surfaces (82, 84) with diversified diameters.

18. The apparatus according to claim 17, wherein the surface (82) of the cylindrical body (80) of the rolling mandrel (24), turned to the external part of the cylindrical body and in the direction of the rotating table, has a larger diameter than that of the adjusting surface (84), located in an intermediate portion of the cylindrical body (80), and is linked with the surface (84) by means of an angled curtail riser (86).

19. The apparatus according to claim 17, wherein the rolling mandrel (24) includes a cylindrical support (88) located inside the flanged sleeve (76), fastened to the flange by screws (90) and with a third sleeve (92) with diversified diameter inserted in the axial direction which, close to a rear side, defines a location whereon a helical spring (94) is fitted which, next to a front portion, turned to the rotating table and inside the cylindrical body (80), presents a cylindrically shaped extension (92') and extends along a limited length towards the rotating table starting from a front side of the sleeve and which receives a flanged support (96) from whose lower side, overlooking the third sleeve (92), a tubular appendage (96') extends which enters the third sleeve (92).

20. The apparatus according to claim 19, wherein starting from a rear side of the tubular appendage (96') of the flanged support (96) a shaft (98) is inserted, fastened to the tubular appendage by means of a threaded connection and, inside the flanged support (96) and on an opposite side as to that of insertion of the shaft (98) a shaped pivot (100) is fastened to, through a threaded connection.

21. The apparatus according to claim 20, wherein a front portion of the shaped pivot (100), oriented towards the rotating table, forms a portion with a smaller diameter that is adapted to make up the keying seat of a centering device (102).

22. The apparatus according to claim 20, wherein between the flanged support (96) and a holding body (122), shaped as a bucket with a limited height and a circular section, a plurality of levers (112) are pivoted, by means of a pin or a pivot (110), at whose free end a disc or roller (114) is fastened, matching the surfaces (82) and (84) with diversified diameters of the cylindrical body (80).

23. The apparatus according to claim 22, wherein each of the levers (112), in an intermediate portion of its longitudinal section, defines a seat (116) to receive a wheel or shaped roll (118) equipped, along a surface that is parallel to the rotation axis of the rolling mandrel (24), of a hollow or a groove that is shaped as a function of the collar to be formed on the metal holder (10) and constrained to the levers (112) by means of pivots (120).

24. The apparatus according to claim 23, wherein, inside the holding body (122) and coaxial to it, is located a contrast (126), cylindrically shaped, with an inner surface shaped as a function of the type of metal holder (10), co-operating with a bearing (128).

25. An apparatus for performing the method according to claim 1, wherein the mandrel (26) made of a tang (130) with diversified diameters, of cylindrical shape, on whose lower side, turned in the direction of a shifting plate (30), an opening or hole (132) is formed adapted to receive a rotating shaft or a mandrel-holder, fastened to the shifting plate.

26. The apparatus according to claim 25, wherein on the side surface of the tang (130), in radial position and equidistant from one another, two or more pairs of opposed pockets (134) are formed, which define the lodging seat of a plurality of insert-holding supports (136), these two or more pairs of opposed pockets (134), in a central-upper area of a side surface present a levelling (136') which, starting from the central area of a side surface of each insert-holding support (136), extends towards an end base of the insert-holding support and on a side turned towards the rotating table and is adapted to receive bits or edges (138).

27. The apparatus according to claim 26, wherein the insert-holding supports (136) are located, fastened to and adjusted in the pairs of opposed pockets (134) by means of screws (140).

28. The apparatus according to claim 26, wherein on a front side of the tang (130), in the direction of the rotating table as to which the metal holder (10) is fastened, a centering device (144) is keyed on a pivot or screw (142).

* * * * *